United States Patent [19]

Hodges et al.

[11] 4,335,785

[45] Jun. 22, 1982

[54] APPARATUS AND METHOD FOR CONTROLLING HEAT TRANSFER BETWEEN A FLUIDIZED BED AND TUBES IMMERSED THEREIN

[76] Inventors: James L. Hodges, 3 Hilltop Ave., Vernon, Conn. 06066; Anthony E. Cerkanowicz, 8 Fieldstone Dr., Livingston, N.J. 07039

[21] Appl. No.: 208,141

[22] Filed: Nov. 19, 1980

[51] Int. Cl.[3] ..... F28D 13/00; F28F 13/06

[52] U.S. Cl. ..... 165/39; 165/96; 165/104.16; 122/4 D

[58] Field of Search ..... 165/104.16, 96, 39, 165/134; 122/4 D

[56] References Cited

U.S. PATENT DOCUMENTS

| | | | |
|---|---|---|---|
| 1,747,011 | 2/1930 | Kerr | 165/96 X |
| 1,844,308 | 2/1932 | Armacost | 165/96 X |
| 2,853,279 | 9/1958 | Switzer | 165/134 |
| 2,856,905 | 10/1958 | Bowen | 165/134 X |
| 3,078,919 | 2/1963 | Brown, Jr. | 165/134 X |

FOREIGN PATENT DOCUMENTS

| | | | |
|---|---|---|---|
| 2025014 | 1/1980 | United Kingdom | 122/4 D |
| 309222 | 2/1970 | U.S.S.R. | 122/4 D |

*Primary Examiner*—Albert W. Davis
*Attorney, Agent, or Firm*—William W. Habelt

[57] ABSTRACT

In a fluidized bed of solid particles having one or more heat exchange tubes immersed therein, the rate of heat transfer between the fluidized particles and a fluid flowing through the immersed heat exchange tubes is controlled by rotating an arcuate shield apparatus about each tube to selectively expose various portions of the tube to the fluidized particles.

6 Claims, 3 Drawing Figures

APPARATUS AND METHOD FOR CONTROLLING HEAT TRANSFER BETWEEN A FLUIDIZED BED AND TUBES IMMERSED THEREIN

The Government has rights in this invention pursuant to contract No. EX-76-C-01-2473 awarded by the U.S. Department of Energy.

BACKGROUND OF THE INVENTION

The present invention relates to fluidized bed reactors in general and, more particularly, to an apparatus and method for controlling the rate of transfer of heat from fluidized particles to heat exchange tubes immersed in the fluidized bed so as to control the overall rate of heat extraction from the bed and to maintain the temperature of the bed within a preselected range.

Fluidized bed reactors are well-known in the prior art. In a typical fluidized bed reactor, a bed of solid particles is housed in a chamber, the floor of which is formed of a perforated or slotted plate. A fluidizing gas is introduced into the bed upwardly through the floor of the chamber. The velocity of the fluidizing gas is maintained, by means of controlling gas pressure, above the minimum fluidization velocity, i.e., that velocity at which the entire bed of solid particles is suspended or floated above the floor of the chamber in the fluidizing gas.

If such a fluidized bed reactor as described above is utilized in a process wherein heat is generated within the bed, it is common practice to immerse within the bed one or more heat transfer tubes. A fluid is passed through the heat exchange tubes to absorb a portion of the heat generated in the bed thereby cooling the bed.

Because of the effective mixing of bed solids generated during the fluidization process, a fluidized bed will possess a thermal homogeneity which is useful in many processes. For example, one common application is the use of a fluidized bed reactor as a chemical reactor wherein the fluidizing medium reacts with the solid particles of the bed. As chemical reactions are often exothermic, a cooling fluid is circulated through the immersed heat exchange tubes to cool the bed. The rate of heat transfer to the immersed tubes is controlled to maintain the bed in a temperature range optimal for the continuation of the chemical reaction.

Fluidized bed reactors having heat exchange tubes immersed within the bed are also commonly used as ore roasters. As the roasting of ores, in particular sulfur containing ores, is generally an exothermic reaction, heat must be removed from the bed by circulating a cooling fluid through the immersed tubes. The rate of heat transfer to the immersed tubes is controlled to prevent the temperature of the ore bed from exceeding the fusion point of the ore or dropping below the minimum roasting temperature.

Because of their inherent potential as clean and efficient combustors of coal, fluidized bed reactors are increasingly being utilized as furnaces for steam generators wherein crushed or pulverized coal is the fuel. In a fluidized bed furnace, the coal to be burned is typically mixed with a sulfur sorbent and burned in a fluidized bed, the combustion air serving as the fluidizing gas. Water is circulated through immersed heat exchange tubes and evaporated therein to form steam. In such an application, it is desirable to control the rate of heat transfer to the immersed tubes in order to control bed temperature. A high bed temperature could result in fusion of the bed particles leading to defluidization, while a low bed temperature could cause the combustion process of the chemical reaction within the bed to cease.

The prior art contains a multiplicity of teachings of a variety of apparatuses and methods that have been designed to control the output of or the temperature of a fluidized bed. One such method, disclosed in U.S. Pat. No. 3,047,365, teaches using a direct heat removal means, such as water injection or excess air variation, in conjunction with immersed heat exchange tubes as a means for controlling bed temperature. The major portion of heat would be removed by the immersed tubes with water injection or excess air variation used to fine tune the heat removal. In accordance with the teachings of this patent, water is sprayed onto the surface of the bed or the amount of air used to fluidize the bed is increased in order to cool the bed whenever the bed temperature approaches the maximum permissible temperature. A disadvantage associated with using increased air flow to cool the bed is that the increased fluidizing flow and the increased pressure drop attendant with increased air flow to the bed causes increased sensible heat loss due to dilution and a drop in overall efficiency. The use of water injection exhibits the disadvantage of increasing the dew point of the gases leaving the fluidized bed which can lead to corrosion problems on exposed metal surfaces disposed downstream of the bed.

Another method of controlling the output of or the temperature of a fluidized bed taught in the prior art involves altering the bed height in order to reduce the amount of heat transfer surface immersed in the fluidized bed. U.S. Pat. No. 2,997,286 discloses a fluidized bed reactor wherein the vertical spacing between the immersed heat exchange tubes varies over the height of the reactor chamber, the tubes being closely spaced at the top of the chamber and widely spaced at the bottom thereof. The amount of heat exchange surface immersed in the bed is varied to control the rate of heat removal from the bed by decreasing or increasing the height of the bed. Although theoretically sound, this method has proven impractical in practice.

Another prior art scheme relies on altering the amount of heat transfer surface immersed in the fluidized bed as a means for controlling the rate of heat removal from the bed. In U.S. Pat. No. 3,387,590, the rate of heat removal is reduced by slumping, i.e., deactivating, portions of the fluidized bed. A major disadvantage of this scheme is that the design of the fluidized reactor is much more complex. The chamber must be modularized or an extensive ductwork and damper system must be provided to permit the fluidized air supply to be shut-off to various sections of the bed.

Another scheme known in the prior art is disclosed in U.S. Pat. No. 4,136,642. As taught therein, a second heat exchanger is disposed in the fluidizing air plenum and connected in fluid communication with the heat exchange tubes immersed in the fluidized bed. A portion of the steam generated in the immersed tubes is passed to the second heat exchanger to supply a source of heat to preheat the fluidizing air. If the temperature of the bed drops, the amount of steam being directed from the immersed tubes to the air plenum is increased thereby increasing the temperature of the fluidizing air so that the heat removed from the bed is recycled back to the bed. Alternatively, the amount of steam fed to the air plenum is decreased in the event that bed temperature increases .

Still another apparatus for regulating the rate of heat removal from a fluidized bed is disclosed in U.S. Pat. No. 4,177,765. Therein, the fluidized bed is equipped with a plurality of slidable sleeves circumscribing the heat exchange tubes disposed therein. The rate of heat removal from the bed is controlled by selectively extending or retracting the sleeves over the tubes thereby respectively shielding the tubes from or exposing the tubes to the fluidized bed. A major disadvantage associated with this apparatus is that a large antichamber must be provided adjacent to the fluidized bed to house the tube sleeves when they are retracted from the bed.

Therefore, in view of the need evidenced in the prior art, it is an object of the present invention to provide an apparatus and method for controlling the rate of transfer of heat from a fluidized bed to heat exchange tubes immersed therein having the capability to effectively and efficiently control the overall rate of heat extraction from a fluidized bed and maintain the temperature of the bed at a preselected level.

It is a further object of the present invention to provide such a method and apparatus for controlling the rate of heat transfer to the immersed heat exchange tubes in the form of an arcuate tube shield which partially shields the tube from exposure to the fluidized bed particles, the tube shield being rotatable about the tube to selectively shield and expose different areas of the tube surface.

A still further object of the present invention is to provide such a method and apparatus characterized in that the tube shield is rotated about the tube to selectively shield and expose different areas of the tube surface in response to the temperature of the bed.

SUMMARY OF THE INVENTION

In accordance with the present invention, there are provided a novel and improved method and apparatus for controlling the rate of transfer of heat from a fluidized bed to heat exchange tubes immersed therein. In accordance with the teachings of the present invention, the rate of heat transfer between a fluidized bed of solid particles and a second fluid flowing through one or more heat exchange tubes immersed therein is controlled by rotating an arcuate shield about each tube to selectively expose various portions of the tube to the fluidized bed of solid particles.

The method of the present invention provides for controlling the rate of heat transfer between a fluidized bed of solid particles and a fluid flowing through tubes immersed within the bed and disposed substantially transverse to the flow of fluidizing gas therethrough. The local heat transfer rate to the tube is altered by selectively exposing various portions of the immersed heat exchange tubes to contact with the fluidized particles. To increase the rate of heat transfer, the side surfaces of the tubes are progressively exposed to the fluidized particles. Conversely, to decrease the rate of heat transfer, the side surfaces of the tubes are progressively shielded from the fluidized particles. The rate of heat transfer is maximized by fully exposing the sides of the heat exchange tubes and is minimized by fully shielding the sides of the heat exchange tubes.

The apparatus of the present invention for controlling the rate of heat transfer between the fluidized particles and the fluid flowing through the immersed heat exchange tubes in accord with the method of the present invention comprises a plurality of rotatable arcuate shields, each shield disposed in closely spaced relationship with its associated heat exchange tube, and means for rotating the shields about the tubes, preferably independently of each other and in response to the temperature of the bed, to selectively expose various portions of the heat exchange tubes to the fluidized particles. Each shield comprises an elongated cylindrical sleeve circumscribing the length of its associated tube and having a first and a second elongated cutaway portion, the cutaway portions being disposed diametrically opposite each other. By rotating the shield, the cutaway portions may be aligned to selectively expose various portions of the heat exchange tubes to the fluidized particles in accordance with the method of the present invention.

DESCRIPTION OF THE PREFERRED EMBODIMENT

Figure 1:
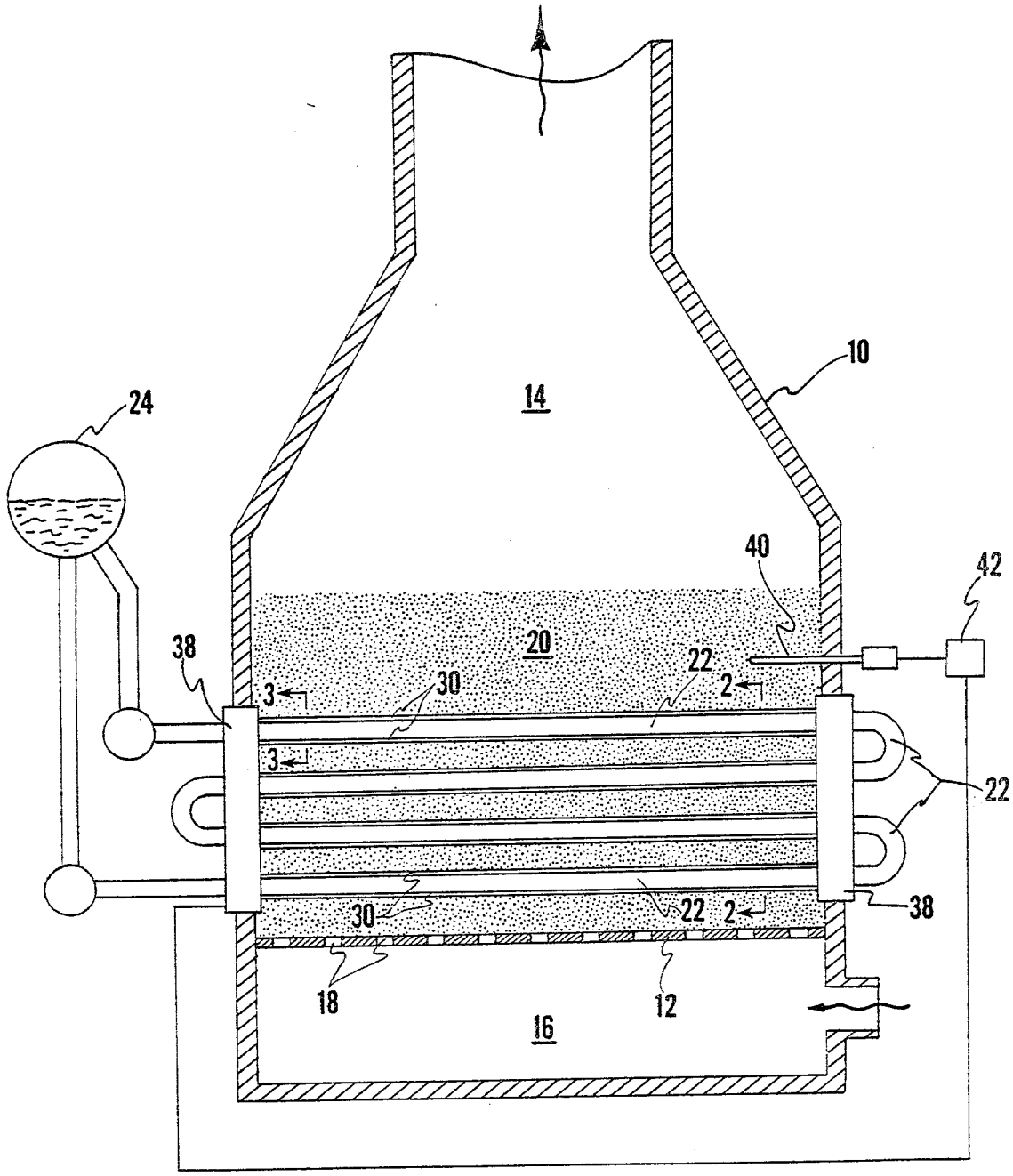
FIG. 1 is a side elevational view of a fluidized bed reactor equipped with the apparatus of the present invention.

Referring to the drawing, and more particularly to FIG. 1 thereof, there is illustrated therein a fluidized bed reactor 10 equipped with the apparatus of the present invention. A bed support plate 12 is disposed within the lower portion of the reactor 10 to divide the interior thereof into a bed chamber 14 above the plate and a fluidizing gas inlet plenum 16 below the plate. A fluidizing gas, such as but not limited to air, enters the inlet plenum 16 and passes upwardly therefrom into the bed chamber 14 through perforations or slots 18 in the bed support plate 12. The velocity of the fluidizing gas is maintained above the minimum fluidization velocity so as to float or suspend the solid particles 20 to form the fluidized bed.

A fluidized bed reactor of the type described above and illustrated in FIG. 1 is frequently employed as a furnace for burning fossil fuels, particularly sulfur bearing fossil fuel such as coal. In such an application the solid particles of the fluidized bed would be formed of crushed coal, a sulfur sorbent, and, if desired, inert particles; and the fluidizing air serves as combustion air for burning the coal. The fluidized bed reactor 10 may also be used as an ore roaster or a chemical reactor or in any of a number of processes well-known in the art. The present invention is applicable to any fluidized bed reactor wherein heat exchange tubes are immersed in the bed, whether used as a furnace, a chemical reactor, an ore roaster, or other process reactor.

In order to control the temperature of the fluidized bed and to utilize the heat generated within the bed, a multiplicity of heat exchange tubes 22 are immersed in the bed and disposed substantially transverse to the flow of fluidizing gas therethrough. A fluid, generally water, is passed through the heat exchange tubes 22 to absorb heat from the solid particles 20. If water is used as the heat transfer fluid, the steam generated as the water vaporizes in the tubes 22 may be collected in a steam-water drum 24 and utilized for driving a turbine generator or processing heating.

In accordance with the present invention, each of the immersed heat exchange tubes 22 is provided with a rotatable accurate shield 30 which is disposed about the tube in closely spaced relationship thereto. The plurality of shields 30 and means for selectively rotating the shields about the tubes 22 comprise the apparatus for controlling the rate of heat transfer between the solid particles and the fluid flowing through the immersed heat exchange tubes.

Figure 2:
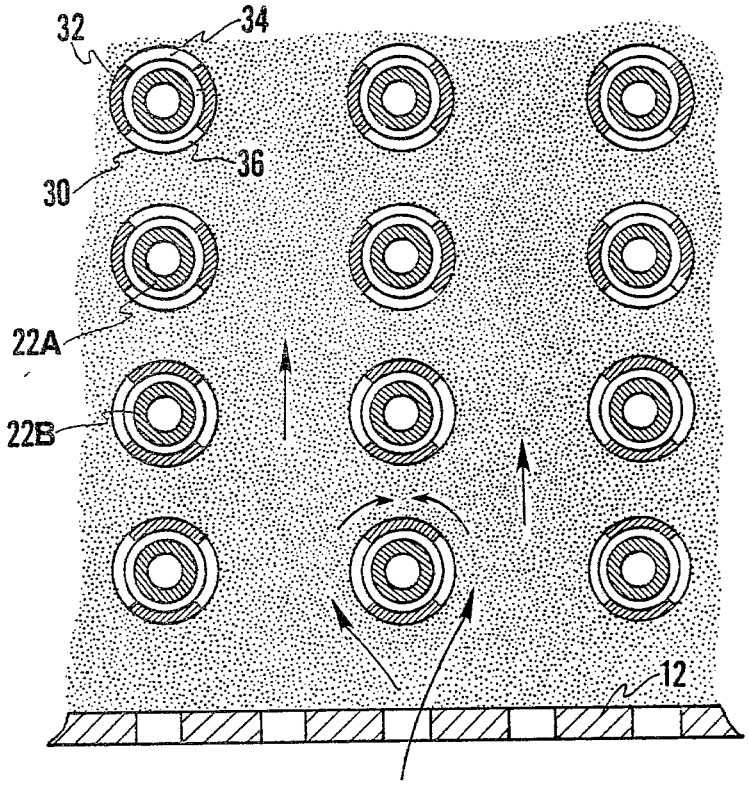
FIG. 2 is a cross-sectional view taken along line 2—2 in FIG. 1.
Figure 3:
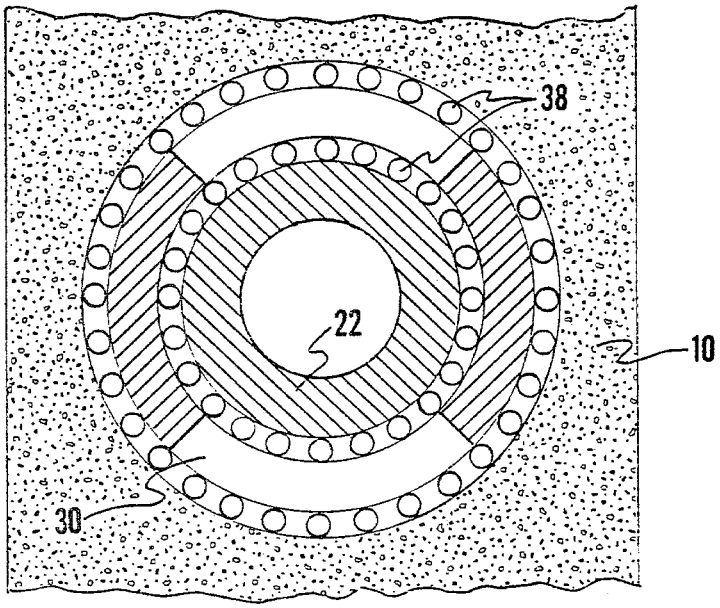
FIG. 3 is a cross-sectional view taken along line 3—3 in FIG. 1.

In a preferred embodiment of the present invention, as shown in FIGS. 1, 2, and 3, each shield 30 comprises an elongated cylindrical sleeve 32 circumscribing the length of its associated heat exchange tube 22. Each sleeve 32 has a first elongated cutaway portion 34 and a second elongated cutaway portion 36 which are disposed diametrically opposite each other, each of which preferably comprises approximately one-quarter of the surface area of the cylindrical sleeve 32.

The ends of the cylindrical sleeves 32 are mounted on bearings 38 in the sidewalls of the reactor 10 so as to be freely rotatable about the tubes 22 so as to selectively expose various portions of the immersed heat exchange tubes 22 to the fluidized particles 20 through the cutaway portions 34 and 36 of the sleeves 32.

Preferably, a temperature sensing device 40 is disposed within the bed to monitor the temperature of the bed of fluidized particles 20. The means for rotating the shields 30, such as a motor operatively associated with each sleeve, is activated to rotate the shields 30 in response to the sensed bed temperature.

Before discussing the operation of the apparatus in accordance with the method of the present invention, it seems appropriate to discuss the mechanism of heat transfer between the fluidized particles and the fluid flowing through the immersed heat exchange tubes. In a fluidized bed, the local heat transfer rate varies extensively around the circumference of the immersed tube. The rate of heat transfer between the upwardly flowing fluidized particles and a transversely disposed tube immersed therein is known to be a maximum at the sides of the immersed tube and a minimum at the top and bottom of the immersed tube. This phenomenon occurs because a quasi-stagnant region is formed above the tube in which particles collect and cool thereby insulating that portion of the tube from the remainder of the fluidized particles; and a void region is formed below the tube as the fluidizing gas passes around the tube thereby precluding contact of the particles with the tube. The sides of the tube, however, are kept clean and exposed to contact with the fluidized particles by the sweeping action of the upward flowing fluidizing gas on the sides of the tube.

In accordance with the method of the present invention, this phenomenon is exploited to control the rate of heat transfer between the fluidized particles 20 and the fluid flowing through the heat exchange tubes 22 by selectively exposing a portion of the tube to the fluidized particles while shielding the remaining portion of the tube from the fluidized particles.

In operation, the cylindrical sleeves 32 of the shields 30 are rotated, either collectively or independently, in response to the temperature of the fluidized bed. The temperature sensing device 40 senses the temperature of the fluidized bed and transmits an electrical impulse to a temperature controller 42 which compares the magnitude of the impulse to a set point indicative of a preselected bed temperature.

If the impulse is higher than the set point, i.e., higher than the desired preselected bed temperature, the controller activates a motor to rotate the shields 30 about the immersed tubes 22 so as to progressively expose the sides of the tubes 22 to the fluidized particles 20 through the cutaway portions 34 and 36 of the sleeves 32. In this manner, the rate of heat transfer between the fluidized particles and the fluid flowing through the tubes is increased, thereby causing the bed temperature to decrease to the desired bed temperature.

Similarly, if the impulse is lower than the set point, i.e., lower than the desired preselected bed temperature, the controller activates a motor to rotate the shields 30 about the immersed tubes 22 so as to progressively shield the sides of the tubes 22 and expose the top and the bottom of the tubes 22 through the cutaway portions 34 and 36 of the sleeves 32 rather than the sides of the tube. Because the local heat transfer rate is highest on the sides of the tube and quite low on the top and bottom thereof, the rate of heat transfer between the fluidized particles and the fluid flowing through the tubes is decreased, thereby causing the bed temperature to increase to the desired bed temperature.

To maximize the rate of heat transfer from the fluidized bed to the fluid flowing through the immersed heat exchange tubes, the sides of the horizontally disposed tubes are fully exposed by rotating the shields 30 so that the cutaway portions 34 and 36 of the sleeves 32 are aligned with the sides of the tubes as illustrated on tubes 22B of FIG. 2. Though the top and the bottom of the tubes are now shielded, this does not significantly reduce the maximum overall heat transfer rate obtainable from that which would exist for a completely unshielded tube because of the low local heat transfer rate which exists at the top and the bottom of the tubes as explained hereinbefore.

In order to minimize the rate of heat transfer from the fluidized bed to the fluid flowing through the immersed heat exchange tubes, the sides of the tubes are fully shielded by rotating the shields 30 so that the cutaway portions 34 and 36 of the sleeves 32 are aligned with the top and the bottom of the tubes 22 as illustrated on tube 22A of FIG. 2. Even though the top and the bottom of the tubes are unshielded, the minimum overall heat transfer rate obtainable is not significantly greater than that which would exist for a completely shielded tube again because of the low local heat transfer rate which exists at the top and the bottom of the tubes as explained hereinbefore.

The following example illustrates the efficacious control of heat transfer rate which is attainable by practicing the teachings of the present invention. It is well-known in the prior art that the heat transfer coefficient on the surface of a tube immersed in a fluidized bed varies significantly around the circumference of the tube. Column A of Table I lists the local heat transfer coefficients on the surface of a horizontally disposed tube immersed in a bed of fluidized particles suspended in a vertically upwardly flowing fluidizing gas, as reported in J. S. M. Botterill's book, "Fluid Bed Heat Transfer", published in 1975 by Academic Press. The angular positions of 0 and 180 degrees represent the horizontal, the angular position of +90 indicates top center of the tube, and the angular position of −90 indicates bottom center of the tube.

Column B of Table I lists the local heat transfer coefficients on the surface of the horizontally disposed tube with the sides of the tube shielded as illustrated in FIG. 2 with reference to tube 22 A. Column C of Table I lists the local heat transfer coefficients on the surface of the horizontally disposed tube with the sides exposed and the top and bottom portions of the tube shielded as illustrated in FIG. 2 with reference to tube 22B.

TABLE I

| Local Heat Transfer Coefficient | | | |
|---|---|---|---|
| | | Shielded Tubes | |
| Angular Position, Degrees | Bare Tube | W/Sides Shielded | W/Sides Exposed |
| +90 | .0179 | .0179 | 0 |
| +80,+100 | .0252 | .0252 | 0 |
| +70,+110 | .0392 | .0392 | 0 |
| +60,+120 | .0571 | .0571 | 0 |
| +50,+130 | .0750 | .0750 | 0 |
| +40,+140 | .0896 | 0 | .0896 |
| +30,+150 | .0980 | 0 | .0980 |
| +20,+160 | .1008 | 0 | .1008 |
| +10,+170 | .0980 | 0 | .0980 |
| 0,180 | .0700 | 0 | .0700 |
| −10,−170 | .0538 | 0 | .0538 |
| −20,−160 | .0448 | 0 | .0448 |
| −30,−150 | .0398 | 0 | .0398 |
| −40,−140 | .0370 | 0 | .0370 |
| −50,−130 | .0358 | .0358 | 0 |
| −60,−120 | .0325 | .0325 | 0 |
| −70,−110 | .0297 | .0297 | 0 |
| −80,−100 | .0280 | .0280 | 0 |
| −90 | .0280 | .0280 | 0 |
| $h_o = \Sigma h_i$ | 1.9545 | 0.6318 | 1.3227 |

It can be seen from Table I that with the tube shields 32 configurated and positioned about tube 22A as shown in FIG. 2, the average heat transfer coefficient on tube 22A will be only about 32 percent of that which would exist on an unshielded tube. However, by rotating the tube shields 32 ninety degrees so as to be positioned about tube 22B as shown in FIG. 2, the average heat transfer coefficient on the tube 22B will be increased to about 68 percent of that which would exist on an unshielded tube.

Thus, in accordance with the present invention, there has been provided a novel and improved apparatus and method for controlling the rate of heat transfer from a fluidized bed to a fluid flowing through heat exchange tubes immersed therein having the capability to effectively and efficiently control the overall rate of heat extraction from a fluidized bed and maintain the temperature of the bed at a preselected level. As illustrated by means of the above example, the rate of heat transfer between the bed of fluidized particles and the fluid flowing through the immersed heat exchange tubes can be widely varied with turndown ratios of more than two to one attainable.

Although the above-recited example is for a tube shielded with a shielding apparatus comprised of a pair of tube shields disposed diametrically opposite each other with each shield covering an included angle of ninety degrees, it will be appreciated that modifications thereof may readily be made thereto by those skilled in the art. For example, the rotating shield apparatus of the present invention might comprise a single shield covering an included angle of other than 90 degrees, such as 120 degrees, or it might comprise two shields, each covering an included angle of other than 90 degrees, such as 60 degrees each, with the two shields disposed diametrically opposite each other or eccentrically to each other. It is intended, therefore, by the appended claims to cover all modifications which fall within the true spirit and scope of the invention as defined in the appended claims.

We claim:

1. In a fluid bed reactor having a fluidized bed of solid particles housed therein, the particles being suspended in a fluidizing gas flowing through the bed, and a multiplicity of horizontally disposed heat exchange tubes immersed within the bed through which a second fluid flows to accomplish the transfer of heat between the second fluid and the bed of fluidized solid particles, the tubes being disposed substantially transverse to the flow of fluidizing gas through the bed, an apparatus for controlling the rate of heat transfer between the second fluid and the bed of fluidized solid particles, comprising a plurality of rotatable arcuate shields, said shields in closely spaced relationship from the immersed heat exchange tubes, and means for rotating said shields about the tubes to selectively expose various portions of the heat exchange tubes to the fluidized solid particles.

2. An apparatus as recited in claim 1 wherein each shield comprises an elongated cylindrical sleeve circumscribing the length of its associated heat exchange tube, each sleeve having a first elongated cutaway portion and a second elongated cutaway portion.

3. An apparatus as recited in claim 2 wherein said first and second elongated cutaway portions are disposed diametrically opposite each other.

4. An apparatus as recited in claim 3 wherein said first and second cutaway portions each comprise approximately one-quarter of the surface area of said cylindrical sleeve.

5. An apparatus as recited in claim 1, 2, 3, and 4 wherein said means for rotating said shields about the tubes to selectively expose various portions of the heat exchange tubes comprises:

a. temperature sensing means disposed within the fluidized bed for sensing the temperature of the bed; and b. means for rotating said shields in response to the sensed bed temperature.

6. An apparatus as recited in claim 5 wherein said means for rotating said shields in response to the sensed bed temperature comprises means for rotating each shield in response to the sensed bed temperature comprises means for rotating each shield in response to the sensed bed temperature independently of the remainder of said shields.

* * * * *